US005377908A

United States Patent [19]

Redman

[11] Patent Number: 5,377,908

[45] Date of Patent: Jan. 3, 1995

[54] DUAL SANITARY NAPKIN DISPOSAL

[75] Inventor: Dennis W. Redman, Acton, Calif.

[73] Assignee: Bobrick Washroom Equipment, Inc., North Hollywood, Calif.

[21] Appl. No.: 101,914

[22] Filed: Aug. 4, 1993

[51] Int. Cl.[6] ..... B65D 91/00

[52] U.S. Cl. ..... 232/43.4; 220/908

[58] Field of Search ..... 232/19, 43.4; 49/171; 220/908, 3.5, 3.6

[56] References Cited

U.S. PATENT DOCUMENTS

| | | | |
|---|---|---|---|
| 1,512,307 | 10/1924 | Pratt | 232/19 |
| 2,530,543 | 11/1950 | Schneeman | 232/43.4 |
| 2,579,379 | 12/1951 | Fritsche | 232/43.4 |
| 2,849,175 | 9/1958 | Thieman | 232/19 |
| 3,129,967 | 4/1964 | Shoenfeld | 232/43.4 |
| 3,979,053 | 9/1976 | Amann | 232/43.4 |
| 4,278,163 | 7/1981 | Tomich | 232/43.4 |

FOREIGN PATENT DOCUMENTS

| | | | |
|---|---|---|---|
| 8700447 | 9/1988 | Netherlands | 49/171 |
| 299213 | 10/1928 | United Kingdom | 49/171 |
| 1034972 | 7/1966 | United Kingdom | 232/19 |
| 1599642 | 10/1981 | United Kingdom | 232/43.4 |

OTHER PUBLICATIONS

Bobrick-Partition-Mounted Accessories For Toilet Compartments.

ASI-Combination Units Seat Cover, Napkin Disposal Toilet Paper Dispenser.

Bradley-Napkin and Tampon Vendors and Disposal Units.

A & J-Toilet Seat Cover Dispensers & Combination Units.

Bobrick-Standard Partition Mounting.

*Primary Examiner*—Michael J. Milano

*Attorney, Agent, or Firm*—Harris, Wallen, MacDermott & Tinsley

[57] ABSTRACT

A dual disposal unit for mounting in openings in washroom divider panels of different thicknesses, having a pair of matched plates for positioning on opposing faces of a panel, with each of the plates having spaced vertical flanges for projecting into the panel opening with a flange of each plate overlying a flange of the other plate within the panel opening, with aligned openings in the overlying flanges for receiving fasteners, and with each of the plates having a cover for movement between closed and open positions providing access to the panel opening. A removable container for placing in the opening.

6 Claims, 2 Drawing Sheets

DUAL SANITARY NAPKIN DISPOSAL

BACKGROUND OF THE INVENTION

This invention relates to disposal units for use in washrooms and the like.

It is common practice today to utilize panels for defining separate stalls in toilets in washrooms, and to mount various accessories on or in the panels. In order to reduce cost and conserve space, dual units are often utilized with an installation in a single panel serving adjacent stalls.

One of the problems encountered with this type of installation arises from the fact that the panels themselves are produced in different thicknesses. Manufacture of a unit which can be installed and used with panels of different thicknesses is difficult, requiring production of units with varying thicknesses in order to match the thickness of the particular panel being used.

It is an object of the present invention to provide a new and improved dual unit which can be manufactured in a single size and which can be easily installed and utilized in panels of varying thickness.

SUMMARY OF THE INVENTION

The presently preferred embodiment of the invention is a dual disposal unit suitable for mounting in openings in panels of different thicknesses and having first and second plates for positioning on opposing faces of the panel.

Each of the plates has first and second flanges spaced from each other for projecting into the panel opening with the first flange of each plate overlying the second flange of the other plate within the panel opening, and with aligned openings in the overlying flanges for receiving fasteners. Preferably the flanges are vertical, with one lower than the other and having slots as openings. Each plate has a horizontal flange, with a support plate resting on one of the horizontal flanges and overlying the other to support a container in the opening.

A cover is carried on each plate for movement between a closed position overlying the panel opening and an open position providing access to the panel opening.

These and other objects, advantages, features and results will more fully appear in the course of the following description.

DESCRIPTION OF THE PREFERRED EMBODIMENT

Figure 1:
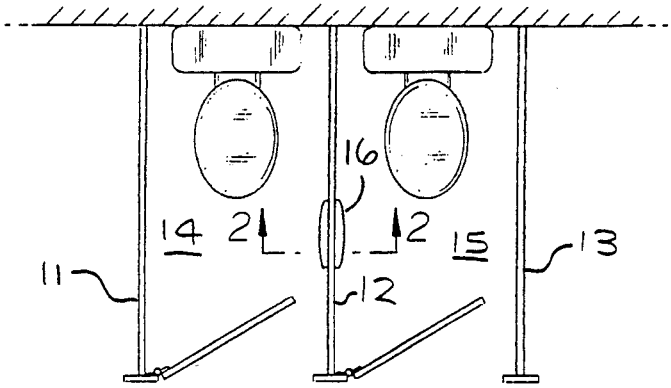
FIG. 1 is a top plan view of a portion of a washroom showing vertical panels defining stalls.

A portion of a washroom is illustrated in FIG. 1 with panels 11, 12, 13 defining stalls 14, 15. A disposal unit 16, typically for disposing of sanitary napkins, is mounted in the panel 12. The disposal unit is available for use by occupants in both stalls 14 and 15, so that no disposal unit need be mounted in panel 11 or pane 13.

Figure 2:
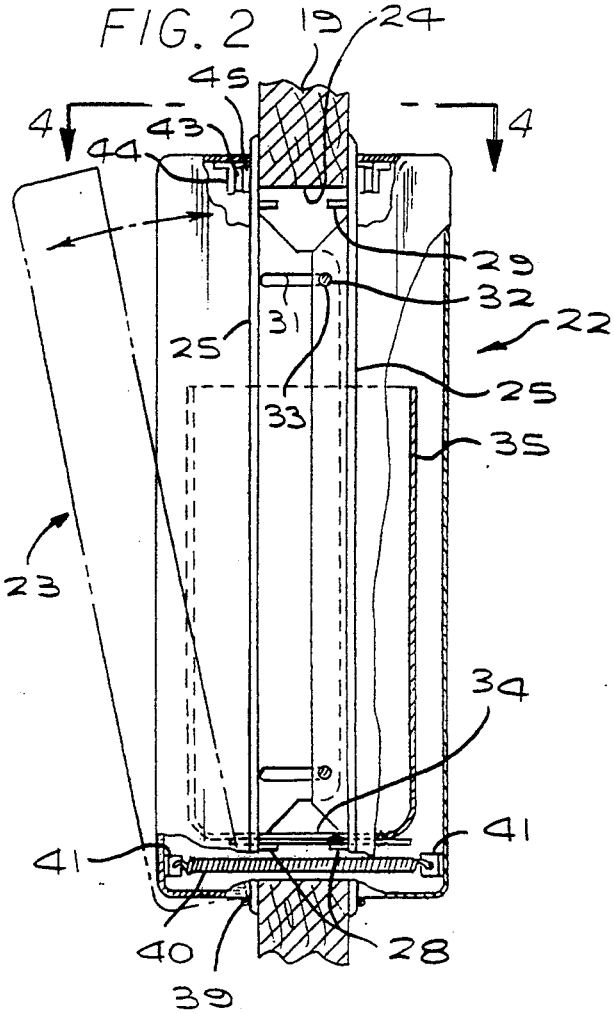
FIG. 2 is an enlarged partial sectional view taken along the line 2—2 of FIG. 1 with a thick panel.
Figure 3:
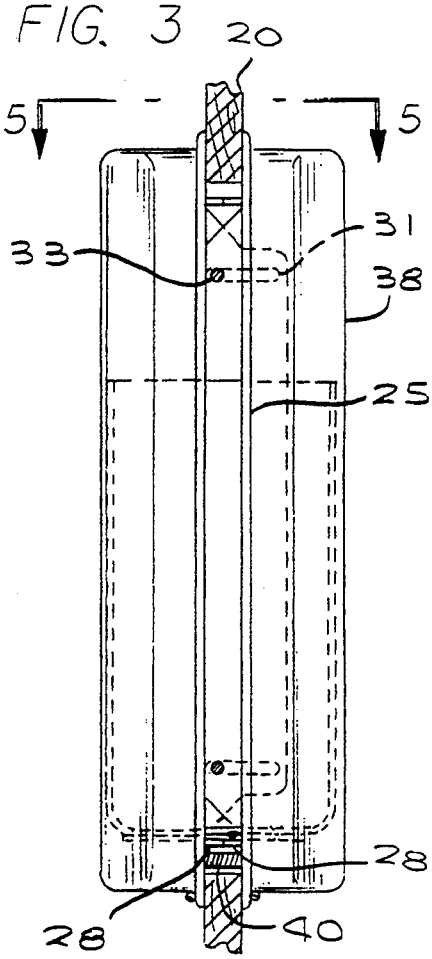
FIG. 3 is a view similar to that of FIG. 2 with a thin panel.
Figure 4:
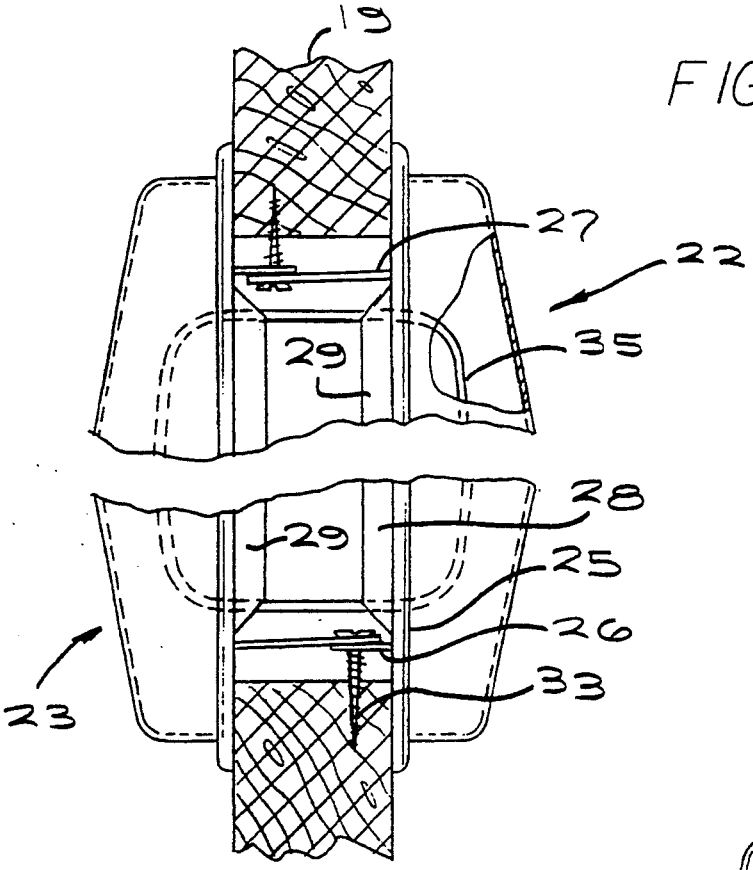
FIG. 4 is a sectional view taken along the line 4—4 of FIG. 2.
Figure 5:
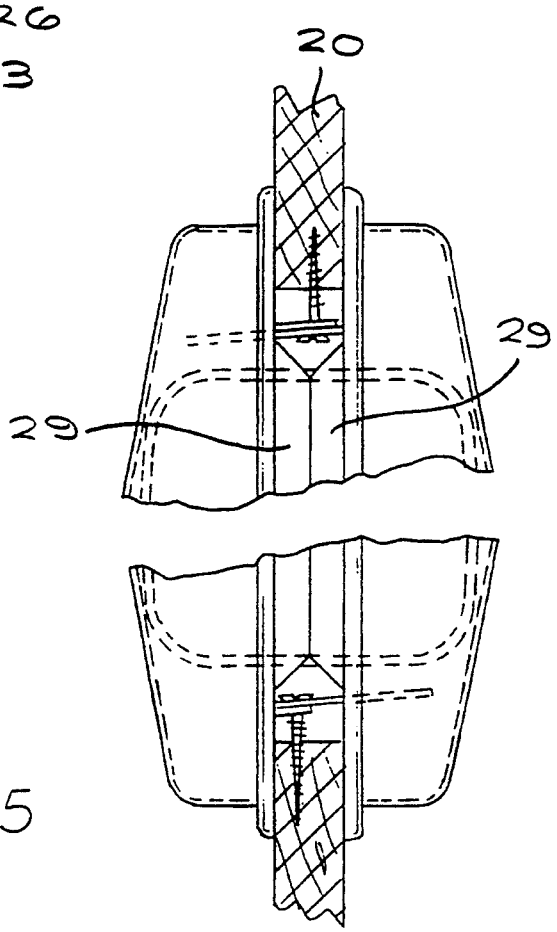
FIG. 5 a sectional view taken along the line 5—5 of FIG. 3.

The presently preferred embodiment of the disposal unit is shown mounted on a thick panel 19 in FIGS. 2 and 4, and on a thin panel 20 in FIGS. 3 and 5. A typical thick panel is in the order of 1 ¼ inches thick while a typical thin panel is in the order of ½ inch thick.

Preferrably the dual unit is produced in two sections 22, 23 which are identical, with one exception to be described later.

Each section includes a plate 25 for positioning against a surface of the panel, with an opening through the plate providing access to an opening 24 in the panel. Preferably the plate 25 is formed of sheet metal with a turned up perimeter and with vertical flanges 26, 27 and horizontal flanges 28, 29 around the opening through the plate for projecting into the opening 24 of the panel.

In the embodiment illustrated, the vertical flanges 26, 27 of one section overlay the vertical flanges 27, 26 respectively, of the other section when the two sections are positioned on opposite sides of the panel.

Aligned openings 31, 32 are provided in the flanges 26, 27 for receiving a fastener such as a nail or screw 33 which passes through the aligned openings in the flanges and into the panel for maintaining the two sections in place on the panel. Typically the fasteners 33 are screws, but could be nails or other types of fasteners as desired. In the embodiment illustrated, the openings 31, 32 are in the vertical flanges, but the construction could be utilized for the horizontal flanges if desired. In the embodiment illustrated, the flange 27 is made wide and the flange 26 is made narrow, with the openings 31 in the wide flanges being slots. With this construction, when the two sections are mounted on a wide panel as shown in FIG. 4, the fastener 33 is near the outer end of the slot 31, as seen in FIG. 2. When the two sections are mounted on a narrow panel as shown in FIG. 5, the overlap of the flanges of the opposing sections is considerably greater, with the fastener 33 being near the inner end of the slot 31, as seen in FIG. 3.

The vertical flanges 26, 27 preferrably are formed slightly off the perpendicular to the plate 25 for ease in maintaining alignment of the two sections.

The horizontal flanges 28, 29 of the two sections preferrably are in line with each other so that they can abut, rather than being overlying. This is best seen in FIGS. 2 and 3. In the preferred embodiment, a support plate 34 rests on the lower horizontal flanges 28. Desirably, the support plate may be attached to one of the flanges by spot welding or the like, such as is shown for the right plate in FIGS. 2 and 3. The upper horizontal flange is 29 are used as stiffners for the plate 25, and are not necessary to the invention.

The attachment of the support plate to the bottom flange of one of the two sections of the dual unit is the only difference between the two sections. The support plate is not necessary, but provides a more stable support to container 35, which may be manually positioned within the dual unit and removed therefrom.

A cover 38 is provided for each of the sections, with the cover preferrably connected to the plate 25 at the bottom by a hinge 39. The cover is moved between a closed position as shown in solid lines and an open position providing for access to the opening in the panel for insertion and removal of the container 35. The cover is shown in a partial open position in phantom lines in FIG. 2.

Spring means may be utilized to urge the two covers to the closed position. A typical installation is a extension spring 40 connected at each end to a bracket 41 which in turn is attached to the inner surface of each cover 38. If desired, a latch may be provided between the upper end of the cover and the plate. A typical latch may comprise a magnet 43 mounted on a bracket 44 attached to the inner surface of the cover, and a strike plate 45 for the magnet mounted on the plate 25. Other spring and latch arrangments may be utilized if desired.

In use, the occupant of either stall may open the cover and place material to be disposed of in the container. Then the cover may be closed manually or merely released and closed by the spring action. At a later time, a maintenance person with open the cover, remove and empty the container, clean it, and replace it in the disposal unit.

I claim:

1. A dual disposal unit for mounting in openings in panels of different thicknesses, comprising first and second plates for positioning on opposing faces of a panel having an opening therethrough;

each of said plates having first and second flanges spaced from each other for projecting into the panel opening with said first flange of each plate overlying the second flange of the other plate within the panel opening, said first and second flanges having openings with aligned openings in said overlying flanges for receiving fasteners, each of said plates having a cover carried thereon for movement between a closed position overlying the panel opening and an open position providing access to the panel opening.

2. A unit as defined in claim 1 wherein said first flange is wider than said second flange, and said first flange opening is a slot.

3. A unit as defined in claim 2 wherein said first and second flanges are vertical, with each of said first and second plates having a third horizontal flange for projecting into the panel opening, and including a horizontal support plate carried on said third flange of one of said first and second plates for overlying said third flange of the other of said first and second plates.

4. A unit as defined in claim 3 including a container positionable in said opening and resting on said said horizontal support plate.

5. A unit as defined in claim 4 including spring means for urging said covers toward said closed position.

6. A unit as defined in claim 5 including latch means carried on said cover and plate for latching said cover in said closed position.

* * * * *